United States Patent [19]

Wallner et al.

[11] Patent Number: 4,536,054

[45] **Date of Patent: * Aug. 20, 1985**

[54] FUSE HOLDER, ESPECIALLY FUSE HOLDER FOR ELECTRICAL DEVICES

[75] Inventors: Peter Wallner, Kriens; Peter Hollenstein, Lucerne, both of Switzerland

[73] Assignee: Schurter AG, Lucerne, Switzerland

[ * ] Notice: The portion of the term of this patent subsequent to Jun. 12, 2001 has been disclaimed.

[21] Appl. No.: 543,170

[22] Filed: Oct. 19, 1983

[30] Foreign Application Priority Data

Nov. 12, 1982 [CH] Switzerland ..... 6592/82

[51] Int. Cl.[3] ..... H01R 3/00

[52] U.S. Cl. ..... 339/147 R; 337/195; 337/201

[58] Field of Search ..... 339/147 R, 256 C, 256 S, 339/258 RR, 258 TC; 337/187, 195, 201

[56] References Cited

U.S. PATENT DOCUMENTS

| | | | |
|---|---|---|---|
| 2,386,060 | 10/1945 | Powell | 339/201 |
| 4,002,400 | 1/1977 | Evans | 339/258 R |
| 4,453,794 | 6/1984 | Wallner et al. | 339/147 R |

*Primary Examiner*—Gil Weidenfeld
*Assistant Examiner*—Gary F. Paumen
*Attorney, Agent, or Firm*—Werner W. Kleeman

[57] ABSTRACT

The fuse holder contains a socket and a head member loosely seated in the socket by a quick release closure, and can be removed along the lengthwise axis of the fuse holder. Seated in the socket at its closed end is a base contact containing a connection tab and a lateral contact having a connection tab. At the head member, the closed end of which is located at the open end of the socket, there is provided a substantially U-shaped, asymmetric connection conductor fixedly clawing into the head member by retaining flaps provided at a web portion of the connection conductor. The unequal legs of the connection conductor extend from the web portion at an inclination inwardly at a predetermined location towards the lengthwise axis of the fuse holder to an internal contact location for a first cap member of the fuse insert. A second cap member thereof is pressed by an axial compression spring against the base contact. One leg of the connection conductor again extends outwardly at an inclination up to an external contact location where it produces a frictional connection with the lateral contact. The other leg of the connection conductor extends outwardly at an inclination up to a supporting location at the inside of the head member and bears with its support arm against the inside of the head member.

14 Claims, 3 Drawing Figures

FUSE HOLDER, ESPECIALLY FUSE HOLDER FOR ELECTRICAL DEVICES

CROSS-REFERENCE TO RELATED APPLICATION

This application is related to the commonly assigned, copending U.S. application Ser. No. 06/402,308, filed July 27, 1982, entitled "Fuse Holder, Especially Fuse Holder For Electrical Devices", now U.S. Pat. No. 4,453,794, granted June 12, 1984.

BACKGROUND OF THE INVENTION

The present invention relates to a new and improved construction of a fuse holder, especially a fuse holder for various electrical devices.

Generally speaking, the fuse holder of the present development is of the type comprising a socket formed of an electrically insulating material and extending along a predetermined axis and open at one end thereof. At the open end of the socket there is inserted a substantially tubular-shaped head member formed of an electrically insulating material. This head member is closed at its outer end and is open at its inner end and can be removably inserted into the socket along the aforementioned axis. In the socket there are attached a base or foot contact and a side or lateral contact possessing outwardly directed connection portions. In the head member there are attached a connection conductor and an axially effective pressure or compression spring. The connection conductor is releasably electrically conductively connected with the lateral or side contact. The connection conductor and the compression spring are secured in the head member in such a manner that a fuse insert or fuse located in its work position in the fuse holder makes an electrically conductive contact at its one electrically conductive end with the connection conductor and under the action of the compression spring makes an electrically conductive contact at its other electrically conductive end with the base or foot contact.

With such type of fuse holders, depending upon the design thereof, there can arise a so-called push-button effect which can result in loose or wobble contacts. To avoid this undesired phenomenon it was heretofore necessary to provide complicated measures or facilities by means of which there were optimized the fitting accuracy and material properties.

A further problem existing with such fuse holders resides in retaining the fuse insert inserted into the head member in such a good and positive manner therein that upon removal of the head member the fuse insert does not remain in the socket from where it only can be again removed by performing dangerous manipulations.

In order to preclude this from happening it was necessary to heretofore provide specially designed clamping springs which had to be additionally fabricated and assembled, resulting in a considerable expenditure in manufacturing these fuse holders. If such special clamping springs were not used then it was necessary to work with extremely close fits, rendering it impossible to attain the desired tolerance flexibility or range.

SUMMARY OF THE INVENTION

Therefore, with the foregoing in mind it is a primary object of the present invention to provide a new and improved construction of a fuse holder which is not associated with the aforementioned limitations and drawbacks of the prior art constructions.

Another and more specific object of the present invention aims at providing an economically advantageously fabricatable yet still mechanically and electrically high-grade fuse holder which does not exhibit the aforementioned drawbacks, and furthermore, provides an improved tolerance range or capability.

Still a further significant object of the present invention is directed to a new and improved construction of fuse holder, especially a fuse holder for various types of electrical devices, which allows for adaptation thereof in a most simple fashion so that the same can be reliably and effectively used with different size fuse inserts or fuses.

Yet a further important object of the present invention is to provide an improved construction of fuse holder containing an asymmetrical connection conductor which by virtue of its configuration is firmly supported and anchored in its head member, while affording a savings in material and thus reduced costs for the fabrication of the fuse holder.

A further important object of the present invention is directed to a new and improved construction of a fuse holder composed of relatively simple to manufacture parts, so that the cost of fabrication of the fuse holder is reduced, with the individual parts being supported within the socket of such fuse holder in a highly reliable and positive manner to thereby ensure for proper operation of such fuse holder.

Another significant object of the present invention is directed to a new and improved construction of fuse holder, especially a fuse holder for electrical devices, which is relatively simple in construction and design, economical to manufacture, and extremely reliable in operation.

Now in order to implement these and still further objects of the invention, which will become more readily apparent as the description proceeds, the fuse holder of the present development is manifested by the features that, the connection conductor which is fabricated from a spring or resilient metal is constituted by an asymmetrical connection conductor constructed as a substantially U-shaped bracket member having a web portion extending transversely with respect to the lengthwise axis of the fuse holder and unequal leg portions or members protruding from the web portion. Each leg member of the U-shaped web portion extends inwardly at an inclination with respect to the lengthwise axis of the fuse holder towards an inner contact location for the associated end of the fuse insert. From that location one of the leg portions or members extends outwardly towards an outer contact location forming a frictional connection with the side or lateral contact at the inner side thereof.

The head member of this fuse holder can be selectively connected with the socket either by means of, for instance, a bayonet connection or a slide-snap connection, but also by means of a threaded connection, without there arising the undesirable push-button effect. Also, there are here precluded the errors which occur when using a threaded connection in terms of a faulty or inadequate contact pressure with the lateral contact and connection conductor flushly pressed against one another.

Both the base contact and also the lateral or side contact of the socket can be designed as rigid contacts, and they can be rationally and durably fabricated and installed, since the requisite spring or resilient properties can be completely assumed by the asymmetrical connection conductor and the compression or pressure spring. The compression spring can produce the required contact pressure for the fuse insert with respect to the base or foot contact, whereas the asymmetrical connection conductor, by virtue of the opposed action of its inner contact location with respect to its outer contact location, can produce a good contact pressure both at the lateral contact of the socket and also at the end of the fuse insert.

By virtue of the construction of the unequal leg members of the U-shaped connection conductor so as to extent inwardly at an inclination towards the lengthwise axis of the fuse holder, there is not only possible an extremely good retention of the fuse insert without the need to resort to any special holding spring, but additionally there is provided internally of the head member a great deal of play for providing a tolerance equalization or compensation. In fact this is possible to such an extent that there can be advantageously employed quite different sizes of fuse inserts or fuses if there is only then used a different connection conductor and/or a different compression spring while otherwise employing identical parts of the fuse holder. This renders the fuse holder of the present invention so universal in its application that, by simply exchanging the head member from, for instance, a standard size for the United States to, for instance, a standard size according to the German Industrial Standard, it is possible to easily and rapidly convert the fuse holder so that it can handle different size fuse inserts or fuses. This constitutes an enormous advantage for manufacturers of electrical devices or appliances, since it is now possible to install the fixedly mountable socket into the electrical devices or the like without having to take into account the nature of the fuse inserts or fuses which are intended to be used at a later point in time.

Additionally, the asymmetrical connection conductor can be constructed in a material-saving manner and still so as to possess a sufficient length as concerns its spring or resilient properties.

It is advantageous if the attachment of the asymmetrical connection conductor in the head member is accomplished by clamping the web portion of the U-shaped connection conductor, and thus, there preferably can be provided two retaining or holder flaps or tabs which laterally protrude between the leg portions or members of the U-shaped connection conductor. These holder flaps, upon insertion of the asymmetrical connection conductor into the head member, act in a bending fashion opposite to the insertion direction as barb-like holders or retention elements and prevent the removal of the asymmetrical connection conductor. Because these flaps are located between the leg portions or members of the U-shaped connection conductor, the web portion thereof is desirably reinforced due to the bending of the flaps, so that it practically does not carry out any spring or resilient action when the leg members are moved. This affords a clean separation or demarcation between the mechanical anchoring and the spring or resilient properties of the asymmetrical connection conductor, without there being necessary for this purpose an increased expenditure for the fuse holder.

Particularly with this demarcation of the tasks it is advantageous if the unequal leg members are designed to be domed about the lengthwise axis of the fuse holder. Consequently, they can experience a certain dosed or controllable increase in their spring properties, and additionally, they require less space in radial direction within the head member. The last-mentioned feature is also compatible with the tolerance capability of the fuse holder, without the need to have to unnecessarily increase the thickness of the head member.

By virtue of the provision of the compression or pressure spring it is possible to control in an extremely good manner the tolerance capability of the fuse holder in the lengthwise direction, i.e. axially.

However, the aforementioned doming or arching of the unequal leg members also improves the contact thereof with the related or associated end of the fuse insert, which is thus centered much better and held than between flat leg members of a U-shaped connection element.

By supporting at the head member, the leg portion or member of the U-shaped connection conductor which does not engage the side or lateral contact, high strength and an increase in pressure are made possible.

Particularly when using relatively short fuse inserts or fuses there can be required an extremely close arrangement of the inner contact location and the outer contact location of the one leg member of the U-shaped connection conductor. Especially suitable for this purpose is an arrangement of those parts of the leg members forming such contact locations at the end region or ends of the leg members of the U-shaped connection conductor, wherein there are advantageously subdivided such ends of the leg members into a number of arms. As to these arms or arm members of both leg members at least one of them is constructed as the inner arm forming the inner contact. At least one arm constructed as the outer arm at one leg member forms the outer contact and at the other leg member forms a supporting arm. A preferred arrangement is constituted by a three-finger or three-prong design wherein the outer arm and the supporting arm are arranged between two inner arms. This affords an exceptionally good holding of the fuse insert or fuse.

A simple and spatially small design of the fuse holder therefore can be economically fabricated. The head member and socket can be manufactured from a suitable plastics material, such as thermosetting or thermoplastic resins of known type, and the metal parts can be simply inserted and fixed in place. Also, the metal parts or components can be fabricated as simple mass produced articles, especially by punching, bending, embossing and the like.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
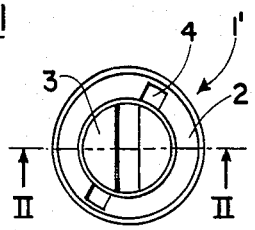
FIG. 1 is a top plan view of the end of a fuse holder containing the head member.
Figure 3:
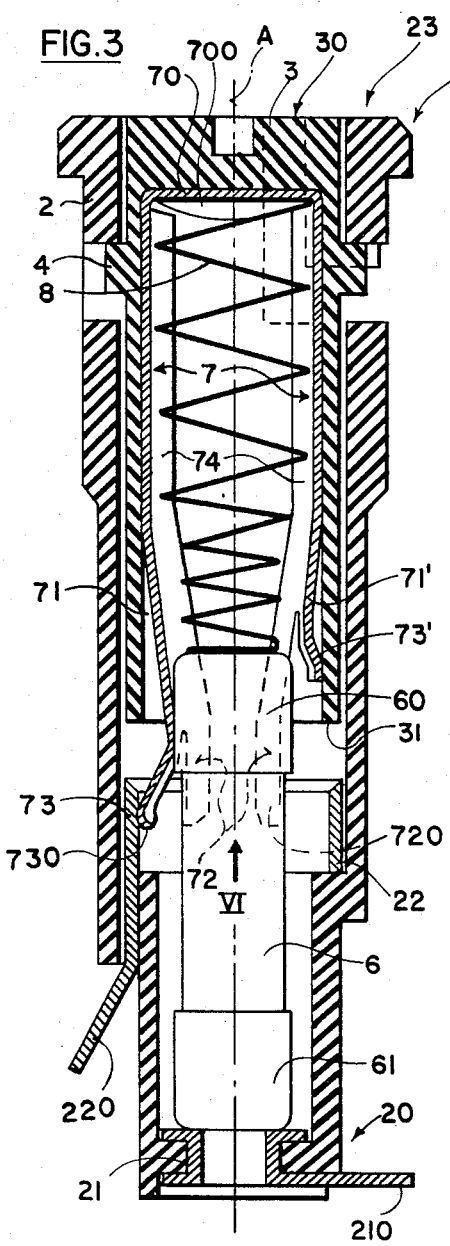
FIG. 3 illustrates a further embodiment of fuse holder depicted in the same sectional view as the arrangement of FIG. 2, with the exception that here there are depicted different constructions of the asymmetrical connection conductor, the compression spring and the fuse insert.
Figure 2:
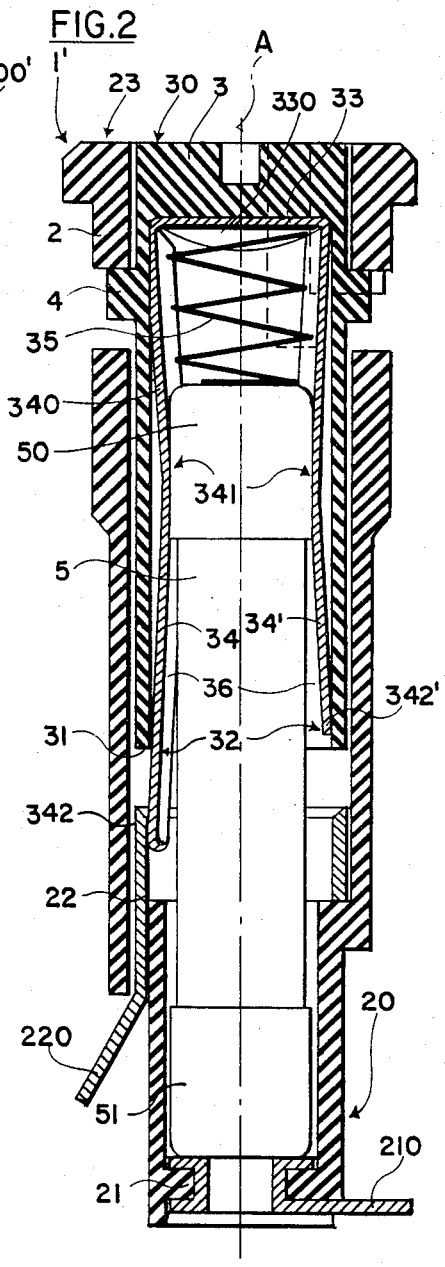
FIG. 2 is an enlarged axial sectional view of the fuse holder depicted in FIG. 1, taken substantially along the line II—II thereof.

Before describing the drawings in greater detail, it is here specifically mentioned that throughout FIGS. 1 to 3 the same parts have been generally designated by the same reference characters inasmuch as the differences between the two illustrated embodiments of fuse holders are essentially only as previously described. Both the fuse holder 1' of the embodiment of FIGS. 1 and 2 and the fuse holder 100' of the embodiment of FIG. 3 each possess a socket or socket member 2 formed of a suitable electrically insulating plastics material and a head member 3 formed of a suitable electrically insulating plastics material. The socket 2 has opposed ends and is internally provided at its closed end 20 with a base or foot contact 21 which extends outwardly in the form of a connection or terminal 210. Furthermore, there is provided a side or lateral contact 22 which extends outwardly to a connection or terminal 220. The sockets 2 of both of the embodiments of fuse holders respectively depicted in FIGS. 2 and 3 are exactly identical to one another.

At the other socket end 23 which is open, there is inserted the head member 3 and such is releasably connected by means of, for instance, a bayonet connection or closure 4 with the socket 2. Instead of using a quick release connection, such as the bayonet connection 4, the socket 2 and the head member 3 also could be connected by screw or thread connection means, and thus, the connection 4 is to be conceptually considered to also constitute such thread or screw connection means. The head end 30 which is in alignment with the socket end 23 is, as shown, closed, whereas the other or opposite head end 31 of the head member 3 which is located within the socket 2 is open.

Thus, the head members 3 of the fuse holder constructions depicted in FIGS. 2 and 3, are identical as concerns their plastic parts and only differ from one another as concerns the so-called fittings or elements located therein.

In the embodiment of fuse holder depicted in FIG. 2 there is provided an asymmetrical connection conductor 32 which is constructed as a substantially U-shaped bracket member. This U-shaped connection conductor 32 has a web portion or U-web 33 which is clampingly retained by suitable holder or retaining tabs or flaps 330 in the head member 3, whereas the unequal leg portions or members 34, 34', also referred to as U-legs, extend approximately in the direction of the lengthwise axis A of the fuse holder towards the side or lateral contat 22. A first portion 340 of each of the leg members 34 and 34' extends at an inclination with respect to the fuse holder-lengthwise axis A inwardly up to the region of the inner contact locations 341, between which there is seated a first end cap or cap member 50 of the fuse 5, whereas a compression or pressure spring 35, due to its action upon this first member cap 50, presses a second end cap or cap member 51 against the base or foot contact 21.

The one leg portion or member 34, constituting for instance a longer leg portion, extends from the related inner contact location 341 to its outer contact location 342 where it forms a frictional connection with the side or lateral contact 22. The other leg portion or member 34', constituting for instance a shorter leg portion, extends from the related inner contact location 341 towards the inner wall of the head member 3 where it is supported at its support location or arm 342'.

Consequently, it is possible, for instance, to produce a fuse holder which can be used with conventional fuse inserts of the type employed in electrical devices or appliances in the United States.

Now if it is intended to use, instead of the fuse insert or fuse 5 depicted in the embodiment of fuse holder shown in FIG. 2, a smaller fuse insert or fuse, for instance a European-type fuse insert 6 containing the end cap members or caps 60 and 61, then the socket 2 and the base contact 21 as well as the lateral or side contact 22, and even the head member 3, can be left unaltered in the modified arrangement of FIG. 3, whereas the asymmetrical connection conductor 32 of the embodiment of fuse holder of FIG. 2 would be replaced by an asymmetrical connection conductor 7 of the type shown in FIG. 3. Also this asymmetrical connection conductor 7 is constituted by a substantially U-shaped metal bracket having unequal legs 71 and 71' and whose web portion 70, also referred to as a U-web 70, is retained by the holder or attachment tabs or flaps 700, whereas its unequal length or unequal constructed leg portions or members 71 and 71', also referred to as the U-legs, initially extend parallel to the lengthwise axis A of the fuse holder 100', then, however, extend inwardly towards the inner contact locations 72 from where the longer U-leg 71 extends outwardly towards the outer contact location 73 and the shorter U-leg 71' extends outwardly to its supporting arm 73'. There are provided the arm members or inner arms 720, intermediate outer arm 730 and intermediate supporting arm 73', apparent from the showing of FIG. 3, by means of which it is possible to arrange in closely neighboring relationship to one another the inner contact locations 72 and the outer contact locations 73 and the supporting arm 73', respectively, and nonetheless to positively retain the fuse insert or fuse 6. Here, the axial pressure is exerted by a compression or pressure spring 8 which, of course, is appreciably longer than the compression spring 35 used with the construction of fuse holder depicted in FIGS. 1 and 2.

As will be readily recognized by measuring the distances in the embodiments of FIGS. 2 and 3, it is not possible to contact by means of the cap member 51 or the cap member 61 of the fuse inserts 5 and 6, respectively, the related lateral or side contact 22 before the end 31 of the head member 3 is at least so close to the end 23 of the socket that the connection conductor 32 or 7, as the case may be, can still be contacted by the hand of the user. With practical embodiments corresponding to the actual size used in practice, it is not possible, with any of the usually employed test or checking fingers of the user, to insert such finger into the socket 2 when the head member 3 is removed, so that also here there is obtained an increased safety against undesirable contact of the internal structure of the fuse holder by the user.

Reference numeral 36 in the embodiment of FIGS. 1 and 2 and reference numeral 74 in the embodiment of FIG. 3 indicates that the leg members or U-legs 34, 34' and 71, 71', respectively, are domed or arched about the lengthwise axis A of the fuse holder, and therefore, have increased spring or resilient properties. This arching or doming contributes to the optimization of the spatial dimensions of the fuse holder.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A fuse holder comprising:

a socket member extending along a predetermined lengthwise axis;

said socket member being formed of electrically insulating material and having an open end;

a substantially tubular-shaped head member removably inserted into said open end of said socket member along the lengthwise axis thereof;

said head member being closed at an outer end thereof and being open at an inner end thereof and being formed of electrically insulating material;

a base contact and a lateral contact containing outwardly directed connection portions secured in said socket member;

a connection conductor arranged in said head member and releasably electrically conductively connected with the lateral contact;

an axially effective compression spring;

said connection conductor and said axially effective compression spring being secured in said head member such that a fuse insert, when located in a work position thereof in the fuse holder, electrically conductively bears at one electrically conductive end thereof at the connection conductor and under the action of said compression spring bears by means of a further electrically conductive end thereof at the base contact;

said connection conductor being formed from a spring metal and defining a substantially U-shaped bracket member having a web portion and unequal leg members;

said web portion extending transversely with respect to the lengthwise axis of the socket member and said unequal leg members protruding from said web portion;

each leg member extending at an inclination inwardly from the web portion towards an inner contact location for a related end of the fuse insert; and one of said leg members extending outwardly from said inner contact location towards an outer contact location where it forms a frictional connection with the lateral contact at an inner side thereof.

2. The fuse holder as defined in claim 1, wherein:

said head member has an inner wall; and the other one of said leg members has a supporting arm extending outwardly from said inner contact location towards and into contact with said inner wall of said head member.

3. The fuse holder as defined in claim 1, further including:

means for clampingly seating said web portion in the head member.

4. The fuse holder as defined in claim 3, wherein:

said clampingly seating means comprises laterally protruding clamping flaps provided for said web portion between the leg members; and said clamping flaps, upon insertion of the connection conductor into the head member, elastically engaging at the head member in the form of barb-like portions bent opposite to the insertion direction of the connection conductor.

5. The fuse holder as defined in claim 1, wherein:

the leg members possess domed locations which are arched about the lengthwise axis of the socket member.

6. The fuse holder as defined in claim 1, wherein:

each leg member possesses a multi-arm end;

said multi-arm end defining at least one inner arm containing an inner contact; and said multi-arm end of said one of said leg members defining at least one outer arm containing an outer contact; and said multi-arm end of the other one of said leg members defining a supporting arm supporting said other one of said leg members at the inside of said head member.

7. The fuse holder as defined in claim 1, wherein:

an intermediate outer arm and two inner arms arranged at opposite sides of the outer arm are provided at an end region of said one of said leg members; and an intermediate supporting arm and two inner arms arranged at opposite sides of said intermediate supporting arm are provided at an end region of the other one of said leg members.

8. The fuse holder as defined in claim 1, wherein:

said head member is exchangeable so as to adapt the fuse holder to handle different sizes of fuse inserts;

said head member being accommodated to the size of the used fuse insert and being equipped with said connection conductor and said compression spring and being exchangeable for a similar type electrically insulated head member which is accommodated to a different size of fuse insert and containing a different connection conductor and a different compression spring.

9. The fuse holder as defined in claim 1, wherein:

said fuse holder is structured to prevent undesired contact with the interior thereof.

10. The fuse holder as defined in claim 1, further including:

bayonet connection means for form-lockingly releasably connecting the head member with the socket member.

11. The fuse holder as defined in claim 1, further including:

thread means for releasably connecting the head member with the socket member.

12. The fuse holder as defined in claim 1, wherein:

said unequal leg members define a longer leg member and a shorter leg member.

13. A fuse holder comprising:

a socket member extending along a predetermined lengthwise axis;

said socket member being formed of electrically insulating material and having an open end;

a head member removably inserted into said open end of said socket member along the lengthwise axis thereof;

a base contact and a lateral contact containing outwardly directed connection portions secured in said socket member;

an asymmetrical connection conductor secured in said head member and releasably electrically conductively connected with the lateral contact;

an axially effective compression spring;

said asymmetrical connection conductor and said axially effective compression spring being secured in said head member such that a fuse insert, when located in a work position thereof in the fuse holder, electrically conductively bears at one electrically conductive end thereof at the asymmetrical connection conductor and under the action of said compression spring bears by means of a further electrically conductive end thereof at the base contact;

said asymmetrical connection conductor being formed from a spring metal and defining a substantially U-shaped bracket member having a web portion and at least two different leg members;

said web portion extending transversely with respect to the lengthwise axis of the socket member and said different leg members protruding from said web portion;

each leg member extending towards an inner contact location for a related end of the fuse insert; and one of said leg members extending outwardly from said inner contact location towards an outer contact location where it forms a connection with the lateral contact.

14. The fuse holder as defined in claim 13, wherein: said different leg members have unequal lengths.

* * * * *